US006171029B1

(12) United States Patent
McGill et al.

(10) Patent No.: US 6,171,029 B1
(45) Date of Patent: Jan. 9, 2001

(54) METHOD AND APPARATUS FOR RETROFITTING UNDERGROUND STORAGE TANKS WITH A CONTAINMENT SUMP

(76) Inventors: Milton D. McGill, 1579 Hidden Canyon, La Habra Heights, CA (US) 90631; Thompson W. Wyper, 1159 W. Fern Dr., Fullerton, CA (US) 92833

( * ) Notice: Under 35 U.S.C. 154(b), the term of this patent shall be extended for 0 days.

(21) Appl. No.: 09/076,680

(22) Filed: May 12, 1998

Related U.S. Application Data

(60) Provisional application No. 60/046,245, filed on May 12, 1997, and provisional application No. 60/060,252, filed on Sep. 29, 1997.

(51) Int. Cl.[7] ..... E02D 7/00
(52) U.S. Cl. ..... 405/249; 405/55
(58) Field of Search ..... 405/249, 52, 53, 405/54, 55, 8; 588/260, 259; 141/86

(56) References Cited

U.S. PATENT DOCUMENTS

| | | | |
|---|---|---|---|
| 4,805,444 | 2/1989 | Webb | 405/52 |
| 4,958,957 | 9/1990 | Berg et al. | 405/52 |
| 4,960,346 | 10/1990 | Tamayo | 405/52 |
| 5,016,717 | 5/1991 | Simons et al. | 405/249 |
| 5,058,633 | 10/1991 | Sharp | 405/55 |
| 5,186,577 | 2/1993 | Reicin et al. | 405/52 |

OTHER PUBLICATIONS

Lilly; "Product Data 788C90007 Surfacing Agent," Product Description; 1 page; 1996.

Organic Peroxides Product Bulletin; "Lupersol Ketone Peroxides;" 5 pages (Undated).

Ashland Oil, Inc.; "Hetron® 922 Vinyl Ester Resin;" 3 pages; Mar. 1991.

An American National Standard; ASTM Designation: D2583–95 "Standard Test Method for Indentation Hardness of Rigid Plastics by Means of a Barcol Impressor;" pp. 79–81; 1995.

Universal "Pipe Line Accessories;" 1 page (Undated).

*Primary Examiner*—Eileen D. Lillis
*Assistant Examiner*—Frederick L. Lagman
(74) *Attorney, Agent, or Firm*—Christie, Parker & Hale, LLP

(57) ABSTRACT

A method of retrofitting an underground storage tank (UST) wherein the sump is installed without first excavating the tank backfill away from the top of the UST or cutting existing piping associated with the turbine pump and UST. The containment sump wall is a prefabricated cylinder or ring of fiberglass-reinforced plastic. The ring is pushed downward into the tank backfill around the turbine pump as backfill material inside the ring is removed. During the installation process, vertical slots are cut into the ring as needed to allow the ring to clear the piping associated with the turbine pump. When the ring is in position around the turbine pump, a sump floor is constructed in place, and bonded to the ring using conventional fiberglass layup technology. Moreover, any piping that penetrates the sump is isolated from the sump wall and floor by means of FRP sleeves, which are bonded to the wall or floor of the sump. Liquid-tight connections between the sleeves and a corresponding pipe are achieved by use of rubber termination boots.

30 Claims, 13 Drawing Sheets

62A
7B
7B
70
70
68

METHOD AND APPARATUS FOR RETROFITTING UNDERGROUND STORAGE TANKS WITH A CONTAINMENT SUMP

CROSS REFERENCE TO RELATED APPLICATIONS

This application claims priority of Provisional Patent Application Nos. 60/046,245 filed May 12, 1997 and 60/060,252 filed Sep. 29, 1997, the subject matter of which is incorporated herein by this reference.

FIELD OF THE INVENTION

The present invention relates generally to containment sumps for underground storage tanks, and more particularly, to an improved method and apparatus for retrofitting underground storage tanks with a containment sump.

BACKGROUND OF THE INVENTION

Estimates place the number of underground storage tanks (USTs) (as defined by the Code of Federal Regulations) in the United States at around 2 million. In 1988, the Environmental Protection Agency promulgated a new set of regulations for USTs, detailing stricter release detection, overfill prevention and containment, financial responsibility, and clean-up requirements. Under this new set of regulations, UST owners were given 10 years to bring their systems into compliance. Instead of replacing non-compliant USTs, many owners have decided to bring their tanks into compliance by upgrading and retrofitting the tanks as necessary.

One of the common areas in which upgrading and retrofitting of existing USTs is necessary is in containment sumps. A containment sump is generally defined as a liquid-tight compartment enclosing the turbine pump and piping connections at the top of an UST, which provides containment of any product leaks. However, conventional methods and processes for retrofitting existing USTs with containment sumps are fairly inconvenient. For example, in order to install the containment sump it is usually necessary to first cut, break up and remove concrete or other paving material overlying the UST and then excavate the tank backfill away from the top of the UST. Additionally, during the installation process it is often necessary to cut the existing piping associated with the turbine pump and UST.

Consequently, a need exists for an improved method and apparatus for retrofitting USTs with a containment sump.

SUMMARY OF THE INVENTION

The present invention, therefore, provides an improved method and apparatus for retrofitting USTs with a containment sump that overcomes the disadvantages of the prior art installation processes. Specifically, only a small area of paving material just around the turbine pump needs to be removed and then the sump is installed without first excavating the tank backfill away from the top of the UST or cutting existing piping associated with the turbine pump and UST.

The containment sump wall is a prefabricated cylinder or ring of fiberglass-reinforced plastic (FRP). The ring is pushed downward into the tank backfill around the turbine pump, while sand or gravel inside the ring is removed by means of a vacuum device. During the installation process, vertical slots are cut into the ring as needed to allow the ring to clear the piping associated with the turbine pump. When the ring is in position around the turbine pump, a sump floor is constructed in place, and bonded to the ring using conventional fiberglass layup technology. Additionally, any slots or other openings made in the ring during installation are also repaired by fiberglass layup. Moreover, any piping that penetrates the sump is isolated from the sump wall and floor by means of FRP sleeves, which are bonded to the wall or floor of the sump. Liquid-tight connections between the sleeves and a corresponding pipe are achieved by use of rubber termination boots.

BRIEF DESCRIPTION OF THE DRAWINGS

These and other features and advantages of the present invention will be appreciated as the same become better understood by reference to the following Detailed Description when considered in connection with the accompanying drawings wherein.

DETAILED DESCRIPTION OF THE INVENTION

Figure 1:
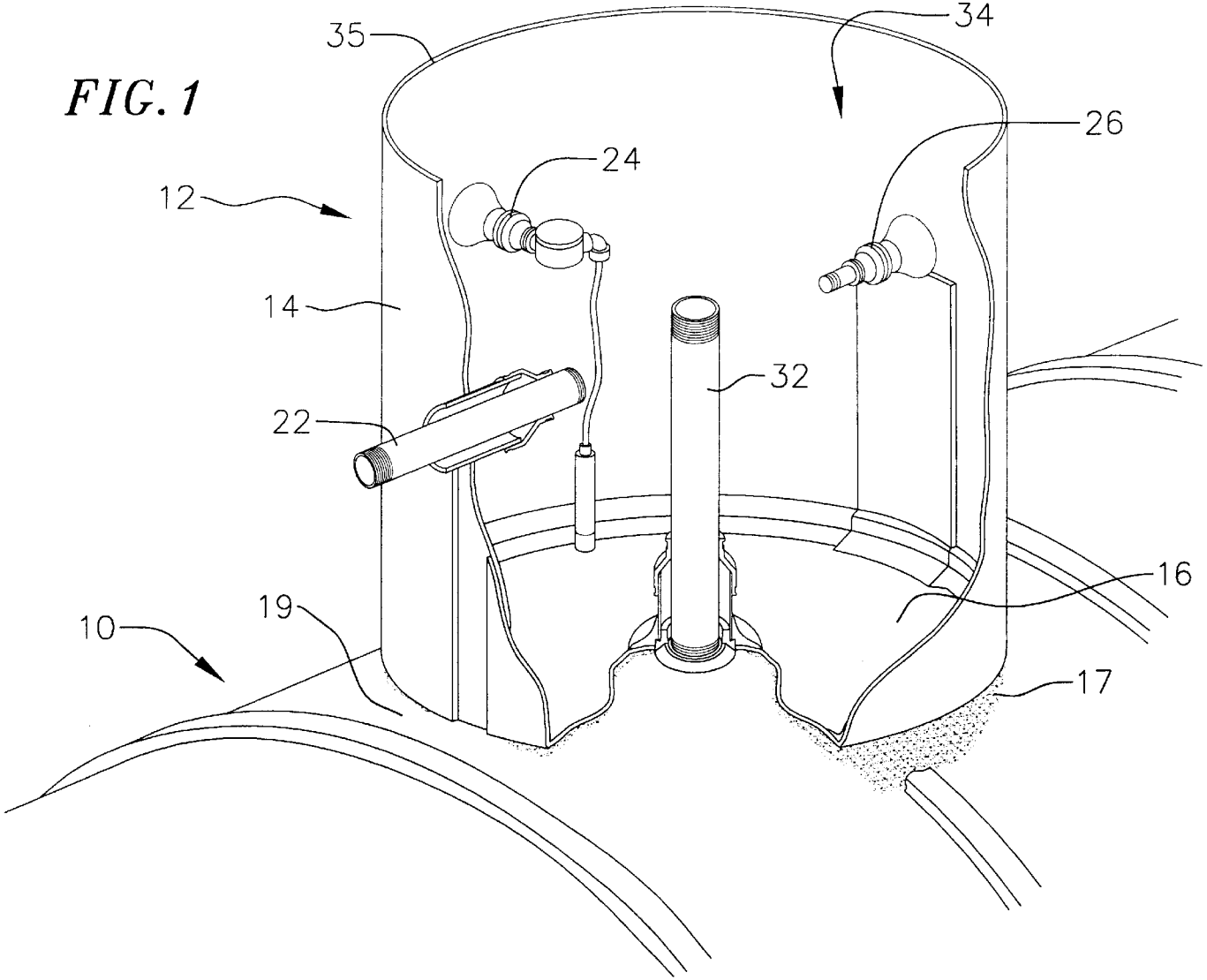
FIG. 1 is a perspective view of a UST retrofitted with a containment sump according to the teachings of the present invention, with a section of the containment sump wall cut away to illustrate the interior of the sump.

Referring now to FIG. 1, an UST 10 retrofitted with a containment sump 12 according to the teachings of the present invention is illustrated. The containment sump 12 includes a cylindrical sump wall or ring 14 and a sump floor 16 bonded to the bottom edge 17 of the ring. A turbine pump 18 (FIG. 2) and a plurality of pipes and conduits are located above the top 19 of the UST and form part of the UST system. The UST system is located underground (FIG. 2), below a concrete tank pad 24 and a layer of tank backfill 26. The tank backfill may be any suitable material used to fill the excavation around the UST and generally includes pea gravel, crushed rock, or sand. A manhole 28 is provided through the concrete tank pad to allow access to the UST system.

In a presently preferred embodiment, the containment sump wall is formed from a cylindrical fiberglass-reinforced plastic (FRP) ring. Suitable FRP rings are available from American Containment located at 3510 Standard Street, Bakersfield, Calif. 93308, having diameters of 42, 48, or 54 inches and a wall thickness of about ¼ to ⅜ inches. The sump floor is preferably constructed from FRP flat stock, fiberglass mat/resin, FRP chop, or some combination of these materials. As used herein, the term FRP chop generally refers to a resin/fiber fillet material produced using a chop gun, such as the Model 2400 or 2500 Series spray gun from Binks Manufacturing Corporation of Franklin Park, Ill. Suitable FRP stock (preferably about ⅜ inches thick for the sump floor), fiberglass mat (preferably about 3 ounces per square yard of mat), and FRP chop are available from American Containment. Additionally, a sump lid 27 may be used with the present invention, such as a 32-inch high density polyethylene from American Containment.

The turbine pump is located within the containment sump 12, and the plurality of pipes and conduits penetrate through the sump wall 14. In the embodiment illustrated in FIG. 1, the plurality of pipes and conduits includes a product pipe 22, an electrical conduit for a sump sensor 24, and an electrical conduit for turbine power 26.

The installation of a containment sump according to the present invention requires a knowledge of UST systems, sump work, and fiberglass layup technology. First, it is necessary to locate the turbine end of the UST, and remove the manhole cover 29 to inspect the turbine and associated piping and conduits, if visible. If the turbine and piping are not visible, it may be helpful to remove sufficient backfill to expose these components of the UST system. Next, the piping and electrical connections are disconnected from the turbine pump and capped, and the turbine pump is removed. Once the turbine pump is removed, the pump riser 32 is capped to seal the tank and prevent backfill or other debris from entering the tank during the installation process. To facilitate installation of the containment sump, a section of the concrete pad above the UST is preferably removed using any of a variety of methods well known in the art.

Figure 2:
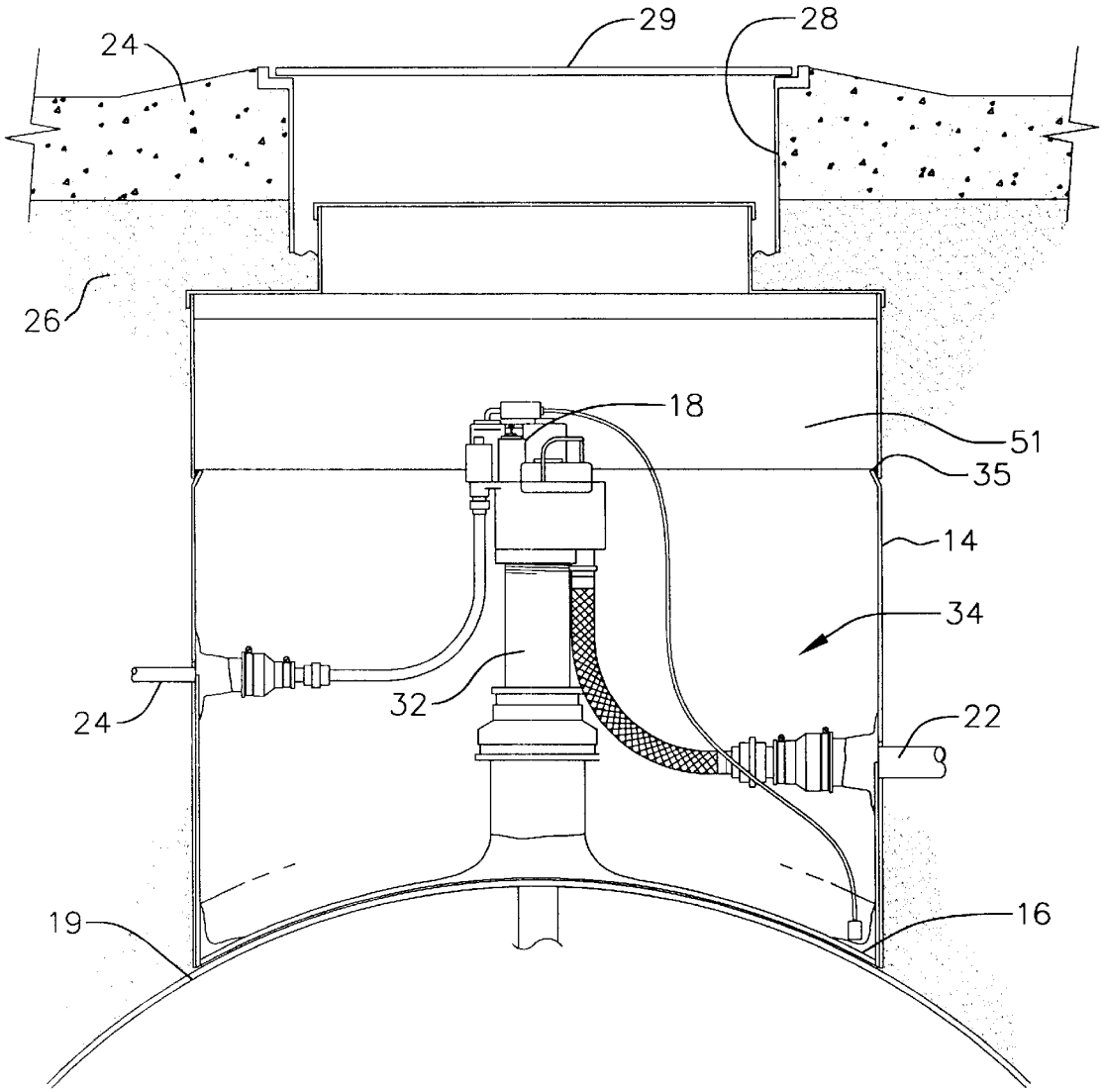
FIG. 2 is a side elevational cross-sectional view of a UST retrofitted with a containment sump according to the teachings of the present invention.

In the presently preferred embodiment illustrated in FIG. 2, the bottom edge 17 of the ring or sump wall 14 has a curvature corresponding to the curvature of the top 19 of the UST. The bottom edge of the ring may be cut at the installation site to match the curvature of the UST, or alternatively may be precut by the manufacturer or supplier of the FRP ring.

In the embodiment illustrated in FIG. 1, the containment sump is constructed with a flat, rather than a curved floor. By using a flat sump floor, the bottom edge of the FRP ring does not have to be cut to match the curvature of the UST. Additionally, the FRP ring can rotate during insertion through the backfill material without resulting in misalignment of the ring with the tank. On the other hand, as a result of using a flat sump floor, sections of the floor are supported by backfill material instead of the UST, which may result in higher stresses be placed on the joint between the sump wall and floor.

The ring is centrally positioned over the pump riser on the backfill material, with the curvature of the bottom edge 17 in alignment with the curvature of the top 19 of the UST in the case where a ring according to the embodiment of FIG. 2 is to be used. Using a suitable device, backfill material is removed from the interior 34 of the ring. As the backfill material is removed from the interior of the ring, the ring is lowered through the surrounding backfill toward the top of the UST. To facilitate lowering the ring through the surrounding backfill, it may be desirable to work the ring gently back and forth as downward pressure is applied to an upper edge 35 of the ring. While working the ring downward toward the UST, it is important to maintain the proper orientation of the curvature of the ring relative to the UST.

It is presently preferred to use a vacuum device to remove the backfill material from inside the ring. The vacuum device utilized in connection with the present invention preferably includes a hose that can be inserted into the interior of the ring to remove the backfill material. An exemplary vacuum device is a diesel powered Vactor "Jet Rodder" vacuum with an 8 inch diameter hose, which has a rating of about 8,000 cubic feet per minute. Those skilled in the art should realize that other suitable industrial vacuum devices may alternatively be utilized as well as mechanical removal methods.

Figures 3, 4:
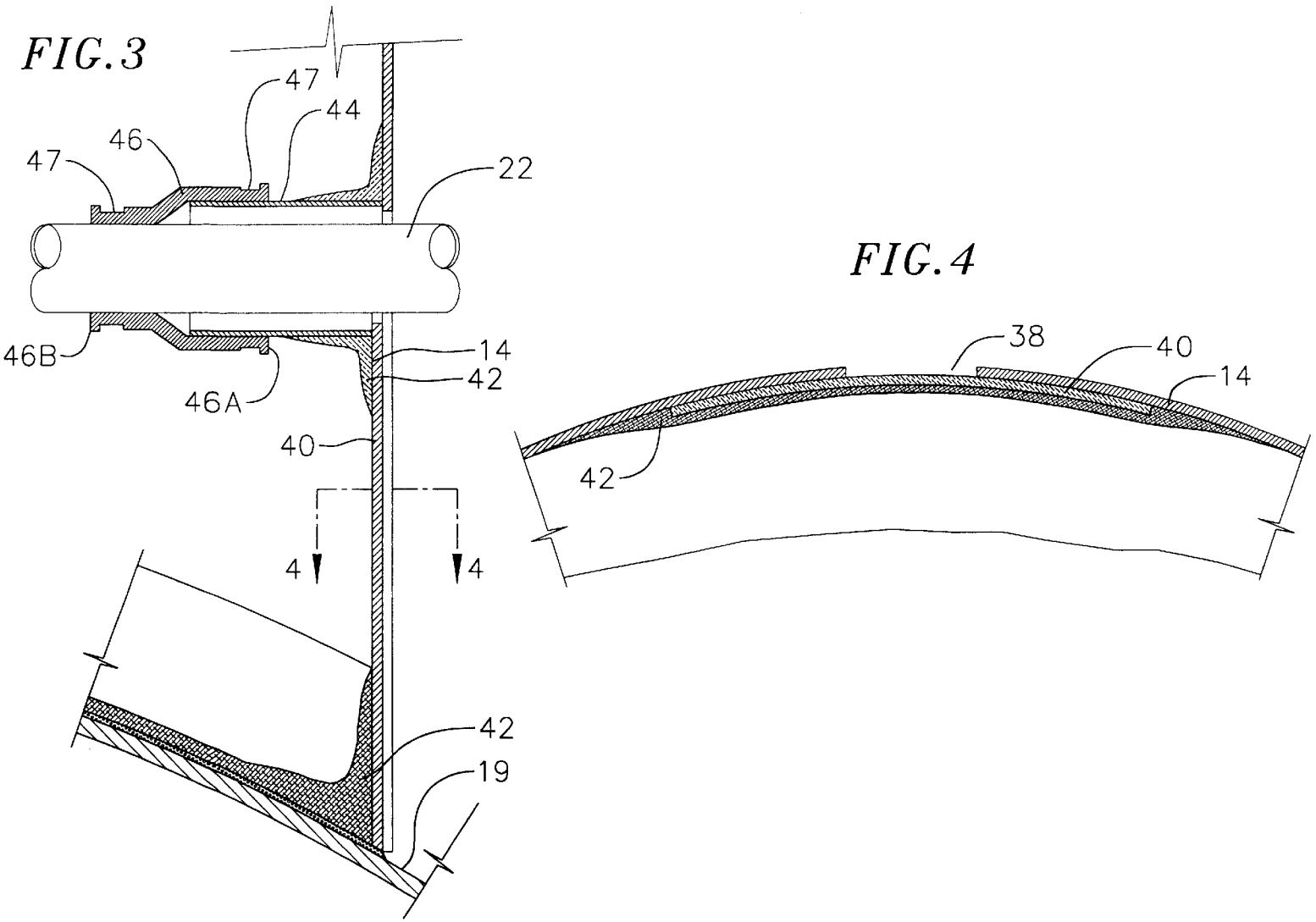
FIG. 3 is a cross-sectional view of the section of the containment sump of FIG. 2 where the product pipe penetrates the sump wall.
FIG. 4 is a cross-sectional view of the sump wall of the containment sump of FIG. 3 taken along lines 4—4.

When the bottom edge of the ring contacts a horizontal pipe or conduit as it is lowered through the surrounding backfill, a corresponding vertical slot 38 is cut in the ring (FIGS. 3 and 4). Thus the containment sump can continue to be lowered through the backfill without cutting any of the existing piping or conduits associated with the turbine pump and UST. Although the number of pipes or conduits that will be encountered during the installation process will vary depending on the particular UST application, it can be expected that at least one FRP product pipe and two electrical conduits will be encountered. The diameters of these pipes and conduits are typically on the order of about 2 inches for the product pipe, and about ½ and 1 inch for the electric conduits. Additionally, in some applications, a separate 2 inch diameter FRP vapor recovery pipe 27 (FIG. 15) may also be encountered.

When the first pipe or conduit is encountered, a mark is made on the interior of the sump wall to designate the location for the corresponding vertical slot formed in the ring. The vertical slot is preferably formed in the ring such that is approximately twice the width of the corresponding pipe or conduit, and of sufficient length to allow the ring to continue moving downwardly toward the top of the UST without contacting the pipe. The slots may be cut in the ring with pneumatic hand grinders, saws, or other suitable means well known in the art. Once the vertical slot is formed in the sump wall, the ring continues to be worked down toward the UST as backfill material is vacuumed from the interior of the ring, until another pipe or conduit is encountered. Once another pipe or conduit is encountered, the steps described above are repeated to form a corresponding vertical slot in the sump wall to allow the ring to pass over that pipe or conduit. The ring continues to be worked down toward the UST as backfill material is vacuumed from the interior of the ring until the top of the UST is exposed and the bottom edge of the ring is approximately ½ inch from the top of the UST.

In the event that the ring begins to flex as a result of the presence of one of the vertical slots, it may be desirable to attach a stiffening plate across the slot at the bottom edge of the ring once the end of the slot has cleared the corresponding pipe or conduit. The stiffening plate may be constructed from FRP, stainless steel or other suitable material, and is preferably attached to the ring by means of stainless steel screws or other conventional fasteners. The stiffening plate may be left in place and covered with fiberglass and resin later in the installation process.

Once the ring is properly positioned over the top of the UST, it is necessary to fill and seal the vertical slots formed in the sump wall during the installation process. Initially, however, backfill material may tend to flow into the interior of the ring through the open vertical slots. Therefore, before starting fill-in work, a piece of stiff cardboard or other suitable material is preferably inserted through each of the vertical slots and positioned outside the ring to temporarily cover or seal the slot.

Once the vertical slots are temporarily sealed, stiffener sections 40 are cut from FRP stock for each vertical slot. The stiffener sections preferably match the curvature of the sump wall, and thus a scrap of FRP ring of the same diameter as the sump wall is a convenient source. Each of the stiffener sections is preferably at least twice the width of a corresponding vertical slot, and of sufficient length to cover the entire slot. The stiffener sections and sump wall are prepared by removing the glaze from the corresponding mating surfaces of the components. Removing the glaze generally refers to the process of roughing up the exposed surface of cured fiberglass to allow a proper bond to be achieved. The glaze may be removed by hand or through the use of a pneumatic sander, grinder, or other suitable apparatus.

For each vertical slot a corresponding stiffener section is positioned over the slot, taking care to maintain sufficient clearance for the pipe or conduit protruding through the slot. The stiffener section is attached to the sump wall, preferably using a quick set epoxy adhesive. Once the adhesive has been allowed to harden, fiberglass chop 42 is sprayed over the stiffener section to fillet it to the sump wall. If desired, fiberglass mat/resin or other suitable material may alternatively be utilized to seal the vertical slots.

Preferably, all of the pipes or conduits that penetrate the sump wall are isolated from the sump wall and floor by means of a sleeve 44, which is bonded to the wall or floor of the sump. Additionally, a liquid-tight connection between the sleeves and pipes or conduits is achieved by means of elastomeric or rubber termination boots 46.

To install the sleeves, the glaze is removed from a corresponding mating surface on the sump wall for each pipe or conduit that penetrates the sump wall. A sleeve is positioned over each pipe or conduit, properly centered, and affixed or filleted to the sump wall with fiberglass chop or other suitable material. Once the sleeve is properly affixed to the sump wall, a rubber termination boot is placed over the exposed inwardly facing end of the sleeve and clamped in place using a pair of radiator-type clamps 48, to form a liquid-tight seal between the sleeve and pipe or conduit. The rubber termination boots preferably taper from a first end 46A, which is placed over the sleeve, to a second end 46B, such that the diameter of the first end of the rubber termination boot is larger than the diameter of the second end of the rubber termination boot. Additionally, a groove 47 is preferably located adjacent each end of the rubber termination boot for receiving a respective one of the radiator-type clamps, to facilitate the forming of the seal between the sleeve and the pipe or conduit.

In a presently preferred embodiment, FRP pipe sleeves or nipples are used to isolate the pipes and conduits from the sump wall. For a 2 inch diameter pipe or conduit, a 3 inch diameter FRP sleeve is preferably used, and for a 1 or ½ inch diameter pipe or conduit, a 2 inch diameter FRP sleeve is preferably used. Suitable FRP pipe sleeves are available from A. O. Smith Fiberglass Products, Inc, located at 2700 W. 65th Street, Little Rock, Ark. 72209, in the Thread II Series in 2 and 3 inch diameters. Additionally, suitable rubber termination boots are available from Weaver Manufacturing, located at 2000 B, Challenger, Oroville, Calif. 95965, as elastomeric PVC flexible couplings, which are available in 3×2 inch and 2×1 inch versions, and may be used with Series 300 stainless steel clamps also available from Weaver Manufacturing.

Figure 5:
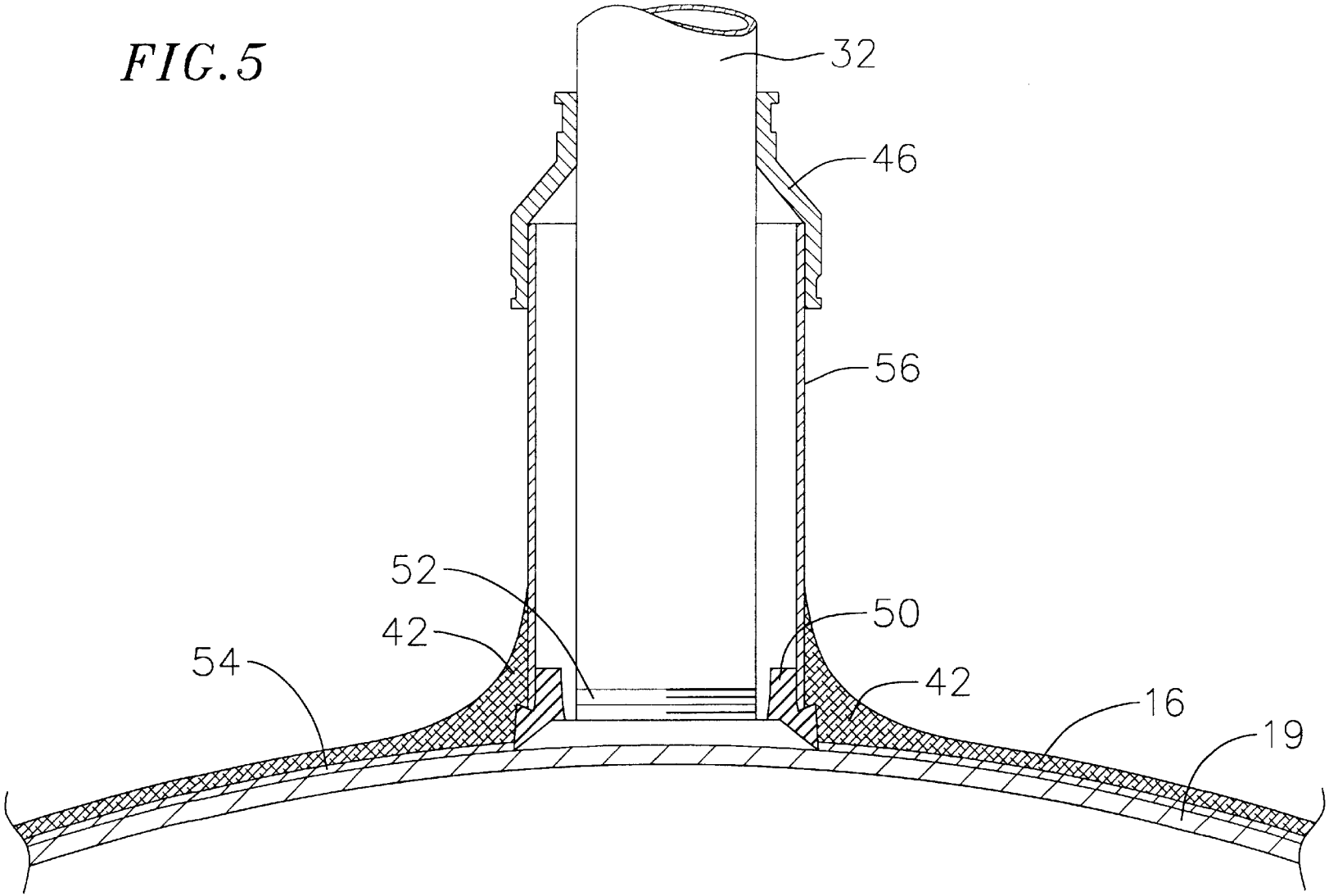
FIG. 5 is a cross-sectional view of the sump riser assembly of the containment sump of FIG. 2.
Figure 6:
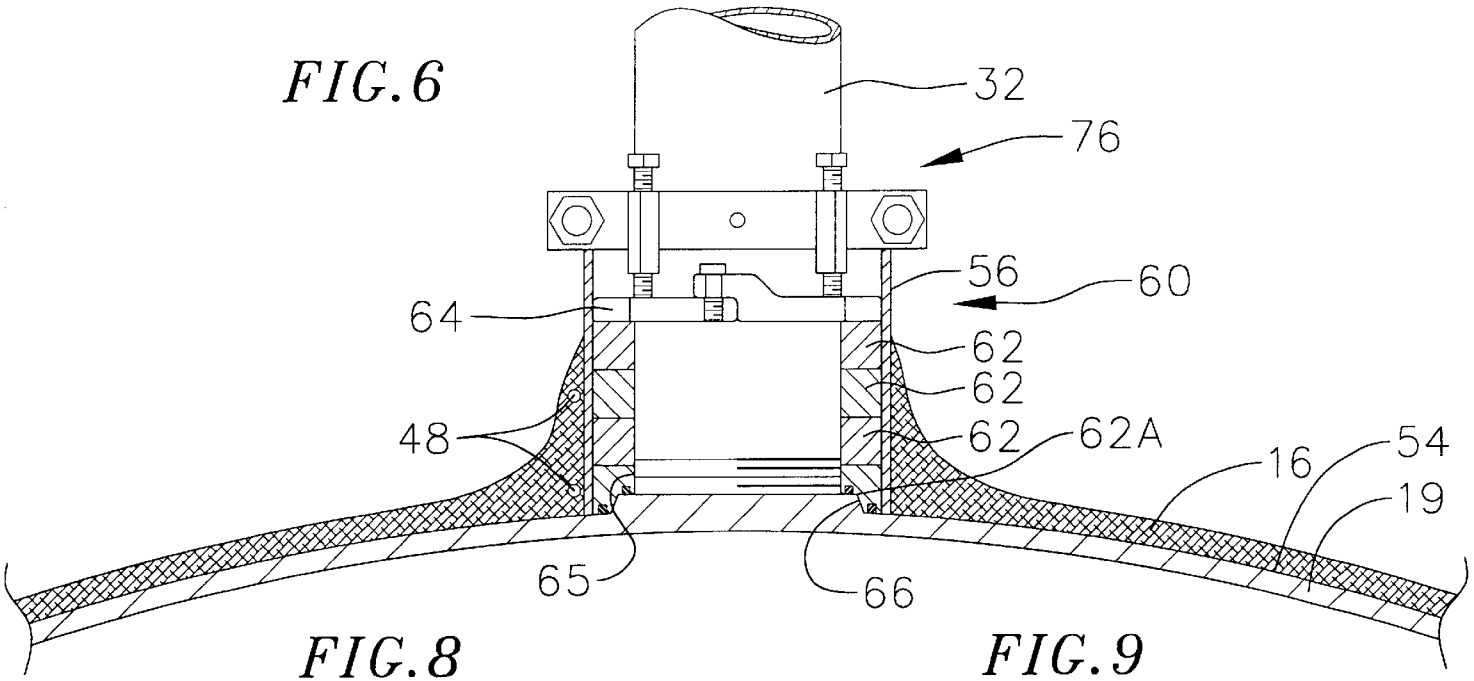
FIG. 6 is a cross-sectional view of an alternate two-piece retrofit assembly for the sump riser.

A similar process is undertaken to isolate the turbine riser from the sump floor (FIG. 5). Once all of the residual debris, dirt, dust, oil, gasoline, etc. has been cleaned from around the turbine riser and top of the UST surrounding the riser, a sleeve 56 is positioned over and properly centered on the turbine riser. Preferably, an elastomeric or rubber seal 59 is positioned over the bottom end 52 of the sleeve to seal the sleeve to the top surface of the UST. As with the horizontal piping and conduits, a rubber termination boot 58 is placed over the exposed end of the sleeve and clamped in place to form a liquid-tight seal between the sleeve and riser. Before tightening the clamp on the rubber termination boot, the sleeve should be pressed downward to compress the rubber seal against the top surface of the UST.

For a 4 inch diameter turbine riser, a 6 inch diameter FRP sleeve is preferably used. Suitable FRP pipe sleeves are available from A. O. Smith Fiberglass Products, Inc in the Thread II Series in 6 inch diameters. Additionally, suitable rubber termination boots are available from Weaver Manufacturing as elastomeric PVC flexible couplings, which are available in a 6×4 inch version, and may be used with Series 300 stainless steel clamps also available from Weaver. The rubber seal is preferably compatible with gasoline, gasohol, methanol, etc., and has a Durometer hardness of about 40 to 50. A suitable rubber seal having these characteristics is available from McMaster-Carr located in Santa Fe Springs, Calif. as Part Number 85175K.

Once the sleeve installation is completed, the sump floor 16 is constructed and bonded to the ring or sump wall 14. First, any remaining debris, dirt, dust, oil, gasoline, etc. is once again cleaned from the top of the UST that is circumscribed by the sump wall. Additionally, any exposed pipe surfaces or fittings are preferably masked to avoid inadvertent contact with fiberglass resin used to construct the sump floor. Next, a thin layer of release agent is applied to the top surface of the UST to prevent adhesion between the sump floor and the UST. A suitable release agent 54 is available from Rexco as Partal Paste #2. The fiberglass mat and resin is applied over the release agent to form the sump floor. Alternatively, FRP chop can be applied directly over the release agent to form the sump floor. Once the floor has been constructed, FRP chop 42 is used to fillet the sump floor to the sump wall and sleeve surrounding the turbine riser, as illustrated in FIG. 1.

After the sump floor has been filleted to the sump wall, the entire containment sump should be inspected for areas of incomplete bonding, and those areas should be repaired as necessary. Once this inspection and repair is finished, a final, continuous resin coating is applied to all interior FRP surfaces. The resin is preferably modified with a surfacing agent so that all surfaces will pass an acetone wipe test.

After the final resin coating has cured, the interior surface of the sump is preferably subjected to a hardness test, acetone wipe test, and hydrostatic test. Using a Barcol Impressor, Model No. 934-1 or 935, to conduct a Barcol Hardness Test, ASTM Method D2583-95, a reading of about 25 to about 30 is preferably observed. Additionally, an acetone wipe test should be applied on the finished resin surface, with no observable tack after wipe. For the hydrostatic test, once the openings in the containment sump are sealed and the turbine riser capped, the sump is filled with water to about 2 inches above the highest point on the sump which has been modified with piping or conduit penetrations. After one hour, no water loss should be observed.

Once any necessary testing of the containment sump is complete, the turbine pump, associated pipe connections, sump sensors, electrical wiring, etc. are reinstalled to return the pump to normal operating status. Additionally, sump riser sections 51 may be added to the top of the sump wall as necessary to bring the sump to a desired height. The backfill is replaced and compacted as needed around the sump, and a new manhole is installed over the sump. Finally, new concrete is poured to replace any of the concrete pad removed during the installation process.

Referring now to FIGS. 6–9, a two piece retrofit assembly 60 for the sump riser is illustrated, which provides a superior seal between the sump riser and UST by placing the elastomeric seal between the riser pipe and underground storage tank under compression. The sump riser retrofit assembly includes a plurality of rubber seals 62 around the riser pipe 32 and compression plate 64 located above the plurality of rubber seals to compress the seals against the top surface 19 of the UST. To install the two-piece sump riser retrofit assembly, the base 65 of the riser pipe and tank bung 66 are first cleaned. A slit FRP sleeve 56 is placed around the riser and suitable adhesive is applied to the edges of the FRP sleeve formed by the slit. While the adhesive is curing in the slit of the FRP sleeve, clamps 48 are preferably placed around the sleeve and tightened. The sleeve assembly is then raised and a bead of urethane sealing caulk is applied at the base of the riser.

Next, the plurality of rubber seals 62 are placed around the riser pipe and positioned inside the sleeve. Each of the plurality of rubber seals 62 has a slit to facilitate installation without removing the turbine riser. The rubber seal 62A (FIGS. 7A and 7B) directly positioned on the top surface of the UST preferably includes a notch 68 to rest on the top surface of the tank bung and a plurality of grooves 70 on its lower surface to receive the urethane sealant as it contacts the base of the riser. In the embodiment illustrated in FIG. 6, four rubber seals are placed around the riser, although the plurality of rubber seals may include anywhere from about two to about six rubber seals as needed.

Figure 8:
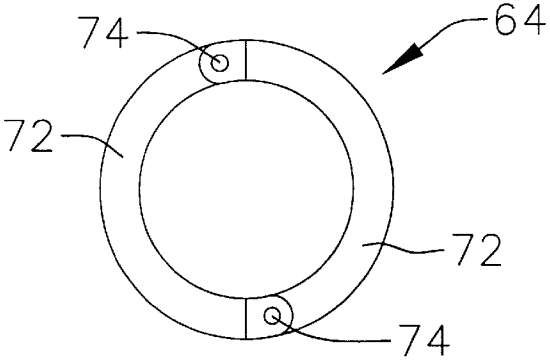
FIG. 8 is a top view of the compression plate of the sump riser retrofit assembly of FIG. 6.
Figures 7A, 7B:
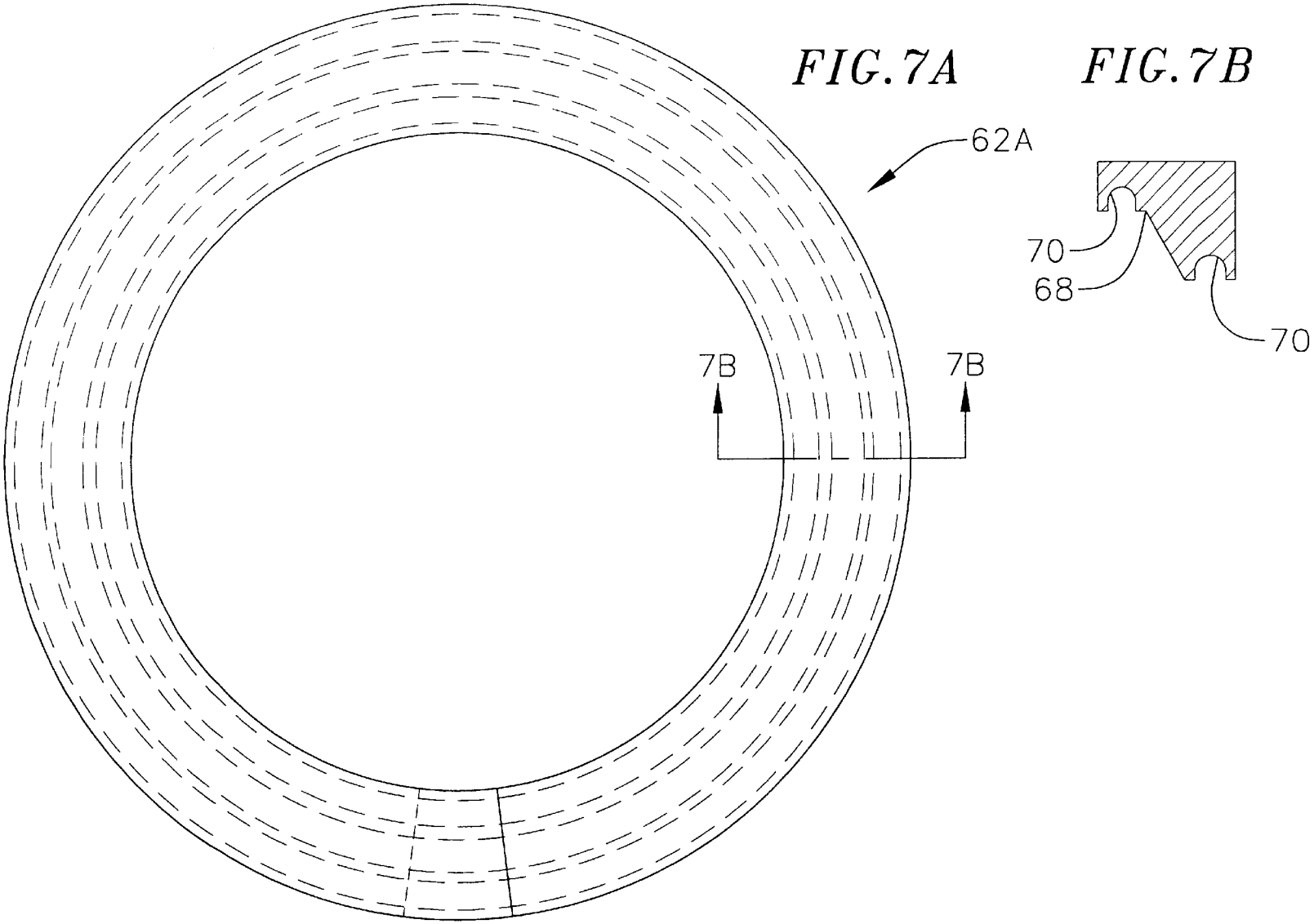
FIG. 7A is a top view of one of the elastomeric seals of the sump riser retrofit assembly of FIG. 6.
FIG. 7B is a side cross-sectional view of one of the elastomeric seals of the sump riser retrofit assembly of FIG. 6 taken along lines 7—7 of FIG. 7A.

A two-piece compression plate 64 is positioned around the riser pipe, directly above the plurality of rubber seals. In the embodiment illustrated in FIG. 6, the compression plate includes a pair of semi-circular components 72 coupled together with a pair of attachment bolts 78 (FIG. 8). The compression plate may be formed from cast iron, steel or other suitable material, and is preferably zinc plated.

Figure 9:
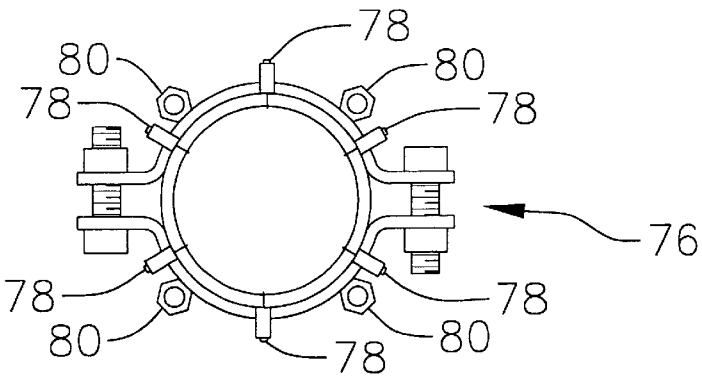
FIG. 9 is a top view of the clamp of the sump riser retrofit assembly of FIG. 6.

Spaced apart from and above the compression plate, a two-piece clamp assembly 76 is provided around the riser pipe (FIG. 9). A plurality of set screws 78 are provided on the clamp assembly for coupling the assembly to the riser pipe. Additionally, a plurality of threaded bores are provided in the clamp assembly for receiving a plurality of drive bolts 80 for driving the compression plate downward to place the rubber seals under compression. The drive bolts provide a convenient means for adjusting the compression on the rubber seals. The clamp assembly is preferably formed from zinc plated steel, although other suitable materials may alternatively be utilized. Once the installation of the two-piece sump riser retrofit assembly is complete, the sump floor is constructed and bonded to the sleeve around the sump riser as described above.

Figure 10:
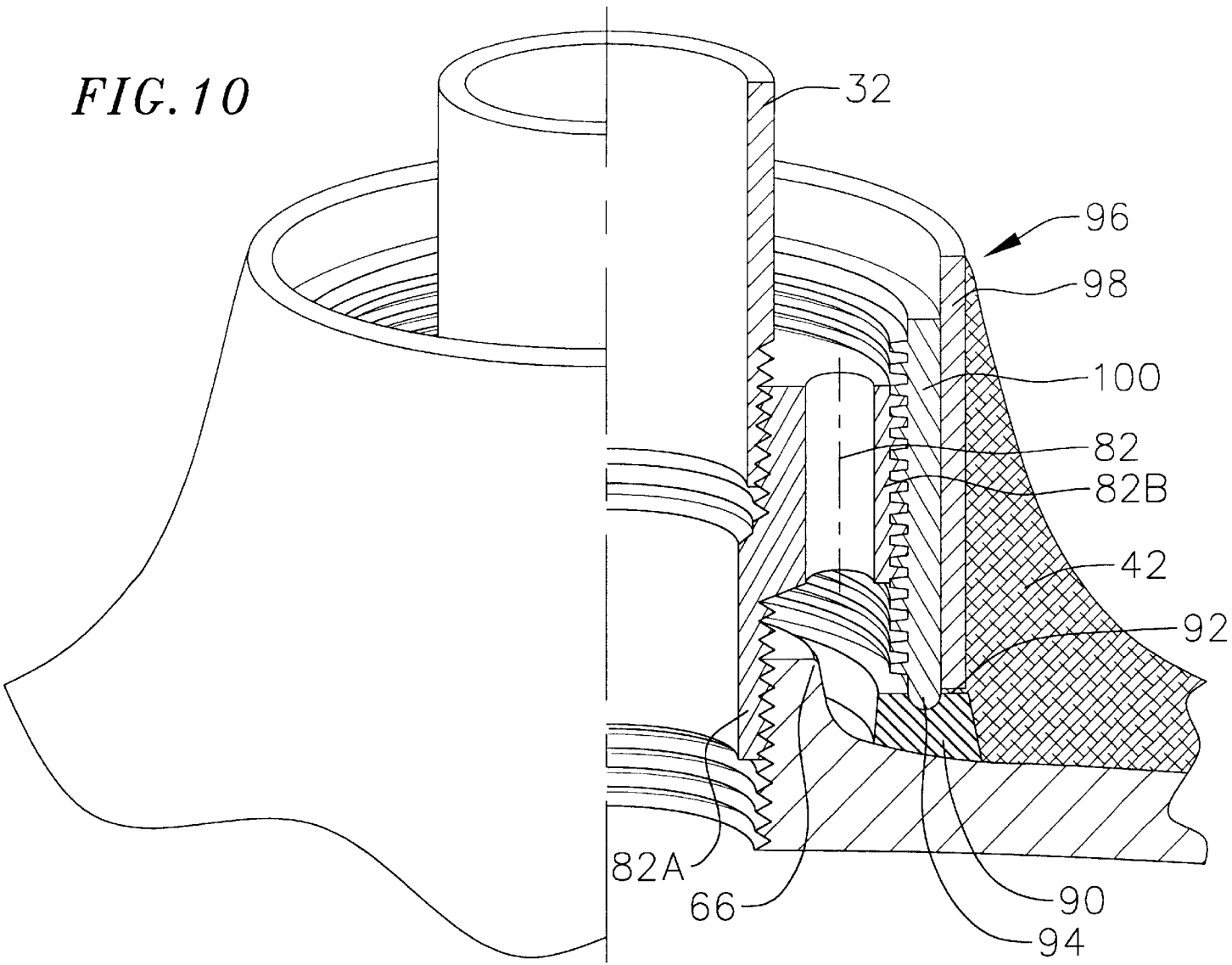
FIG. 10 is perspective view of an alternate embodiment of the sump riser retrofit assembly of FIG. 6, with a section of the retrofit assembly cut away to better illustrate the assembly.
Figure 12:
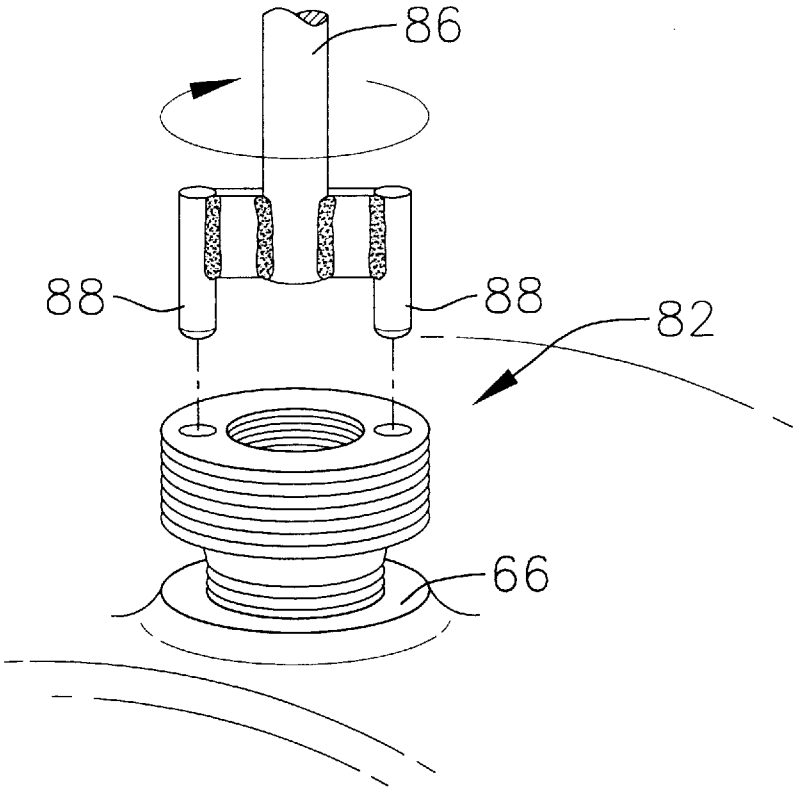
FIGS. 11 and 12 are perspective views of the pipe extender of the sump riser retrofit assembly of FIG. 10 being installed in the tank bung of the UST.
Figure 11:
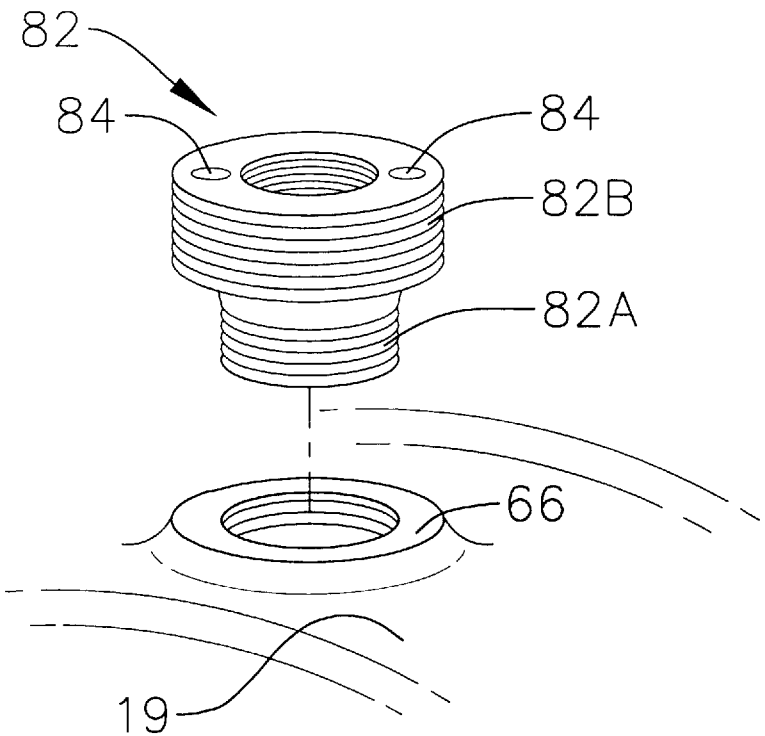

Referring now to FIGS. 10–12, an alternate embodiment of the sump riser retrofit assembly is illustrated which provides a bondable collar to the turbine riser 32 to facilitate bonding the sump floor 16 to the riser. To install this embodiment of the sump riser retrofit assembly, it is first necessary to clean around the tank bung 66 and remove the existing riser pipe 32. A pipe extender 82 is then inserted into the tank bung. The pipe extender illustrated in FIG. 11 includes a lower section 82A, externally threaded for threadably engaging the internally threaded tank bung, and an upper section 82B, externally threaded for threadably engaging the sleeve assembly and internally threaded for threadably engaging the threaded end of the riser pipe. In a presently preferred embodiment, the upper section of the pipe extender is externally threaded with ACME male threads.

The pipe extender may be threaded into the tank bung by any means well known in the art. In a presently preferred embodiment, a pair of apertures 84 are provided on opposite sides of the top surface of the pipe extender for receiving a specially designed tool 86. The tool 86 has a pair of prongs 88 which may be inserted into the apertures of the pipe extender, such that rotation of the tool threads the pipe extender into the tank bung. Preferably, a thread sealer is applied to the first few threads of the lower section of the pipe extender to provide a liquid tight seal.

Once the pipe extender has been installed, a rubber seal 90 is placed over the tank bung. The rubber seal preferably includes a groove 92 in its upper surface for receiving the bottom edge 94 of the sleeve assembly 96. The sleeve assembly includes a standard FRP sleeve 98 that has been modified to threadably engage the externally threaded upper section of the pipe extender. In a presently preferred embodiment, an internally threaded cylindrical member 100 is bonded to the interior surface of the sleeve 98. The internally threaded cylindrical member may be made from cast iron, injection molded plastic, or any other suitable material, and is preferably threaded with a female ACME thread for engaging the male ACME thread of the pipe extender.

The sleeve assembly is aligned over the rubber seal so that the bottom edge of the assembly is received within the groove of the rubber seal. Once properly aligned, the sleeve assembly is tightened onto the pipe extender to compress the rubber seal.

With the sleeve assembly in place, the remaining installation of the containment sump can continue as described above, with the sump floor 16 being fillet to the sleeve using FRP chop 42, the riser pipe being threaded into the pipe extender, and a rubber termination boot being placed over the riser pipe and clamped in place to form a liquid-tight seal between the sleeve and the riser pipe.

Figure 14:
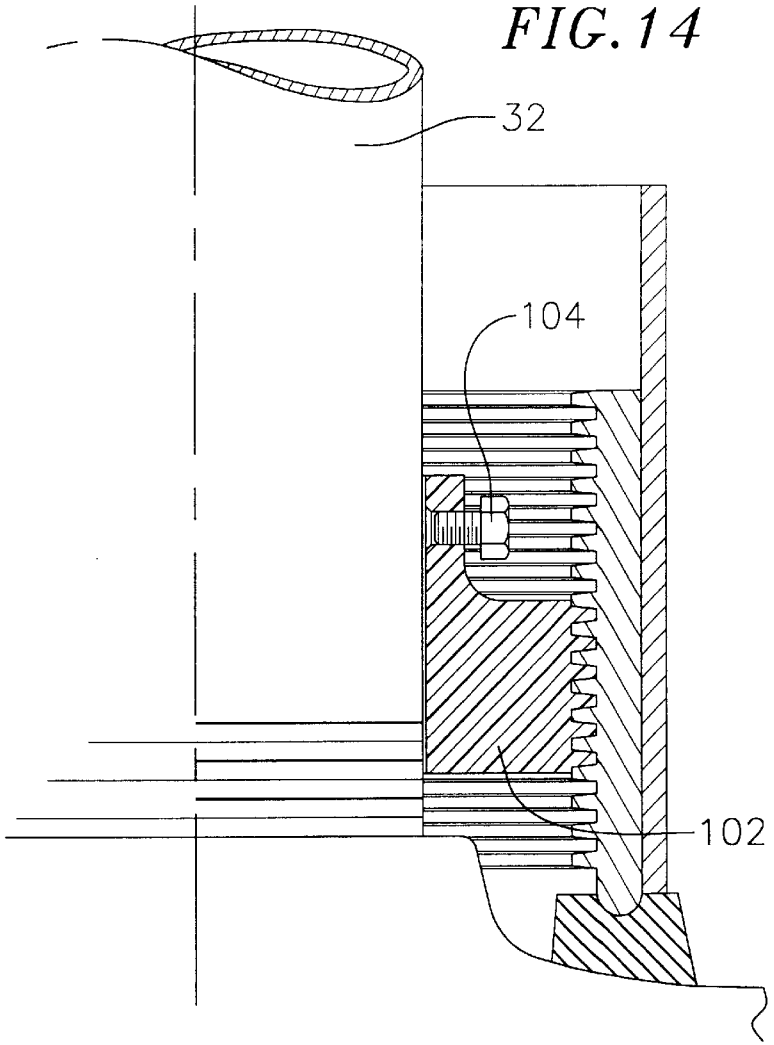
FIGS. 13 and 14 are cross-sectional views of an alternate embodiment of the sump riser retrofit assembly of FIG. 10.
Figure 13:
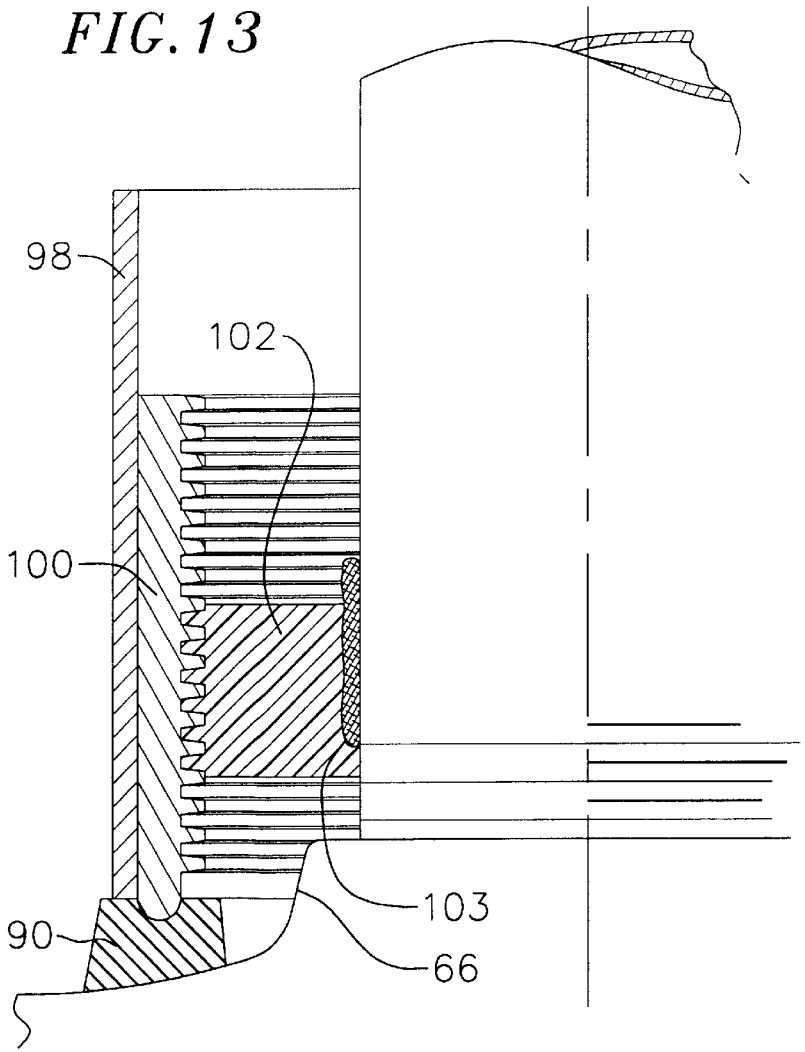

An alternate embodiment of the sump riser retrofit assembly of FIGS. 10–12 is illustrated in FIGS. 13 and 14. In this embodiment, an externally threaded cylindrical member 102 is applied directly to the riser pipe 32, replacing the pipe extender. For example, a molded plastic cylindrical member may be bonded directly to the riser pipe utilizing an appropriate adhesive. The cylindrical member preferably includes a cavity 103 which may be filled with adhesive when installed on the riser pipe. Alternatively, a cast iron cylindrical member may be coupled directly to the riser pipe utilizing a plurality of set screws 104. Once the externally threaded cylindrical member is installed on the riser pipe, the remaining installation process is identical as that described in connection with the embodiment illustrated in FIGS. 10–12.

Figure 15:
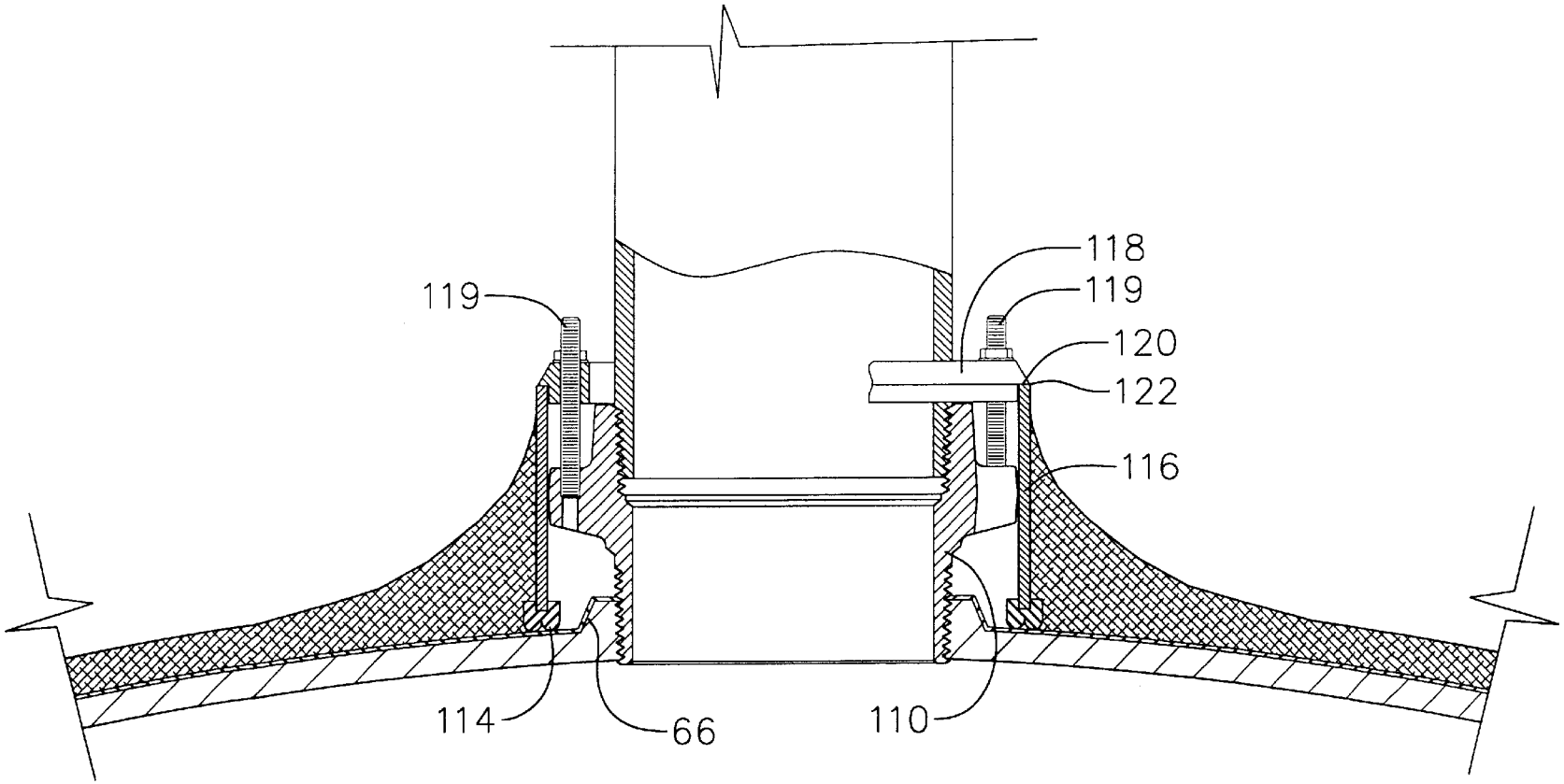
FIG. 15 is a cross-sectional view of a pipe extender of the sump riser retrofit assembly of FIG. 14.
Figure 16:
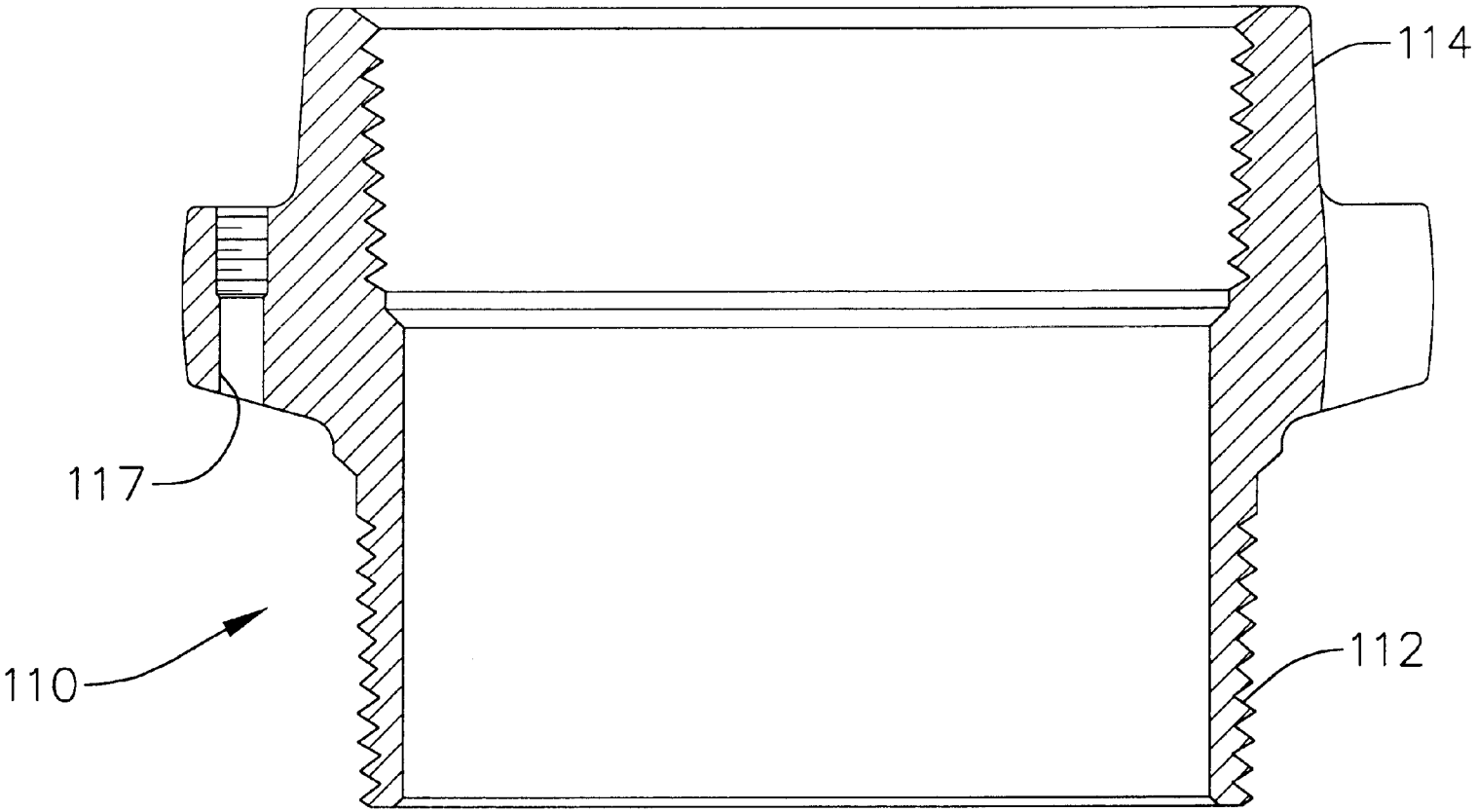
FIG. 16 is a cross-sectional view of the pipe extender.

Another embodiment of the sump riser retrofit assembly is illustrated in FIGS. 15–16. The sump riser assembly includes a pipe extender 110 that is inserted into the tank bung 66. The pipe extender 110 illustrated in FIG. 16 includes a lower section 112 externally threaded for threadably engaging the internally threaded tank bung, and an internally threaded upper section 114 for threadably engaging the threaded end of the riser pipe. As described in connection with the previous embodiments, the sump riser assembly includes a rubber seal 114 placed around the tank bung. The rubber seal preferably includes a groove in its upper surface for receiving a bottom edge of the FRP sleeve 116 placed around the pipe extender.

The pipe extender 110 includes a plurality of threaded bores 117 for receiving a plurality of bolts or studs 119 which cooperate with a clamping assembly 118 to place the rubber seal 114 under compression. Specifically, the clamping assembly is provided above the pipe extender, and includes a plurality of bores corresponding to bores 117 of the pipe extender for receiving the studs. The clamping assembly also includes a upper lip or flange 120 for engaging an upper edge 122 of the sleeve 116. As a result, nuts or other collars may be used on the studs to tighten the clamping assembly toward the UST, which causes the sleeve to be driven toward the upper surface of the UST, due to the engagement between the lip 120 and the upper edge of the sleeve. Therefore, the rubber seal is compressed by the bottom edge of the sleeve, producing a superior seal between the sump riser and the UST. Once the rubber seal is properly placed under compression, the remaining installation process of the sump is identical to that described in connection with the embodiment illustrated in FIGS. 10–12.

Figure 17:
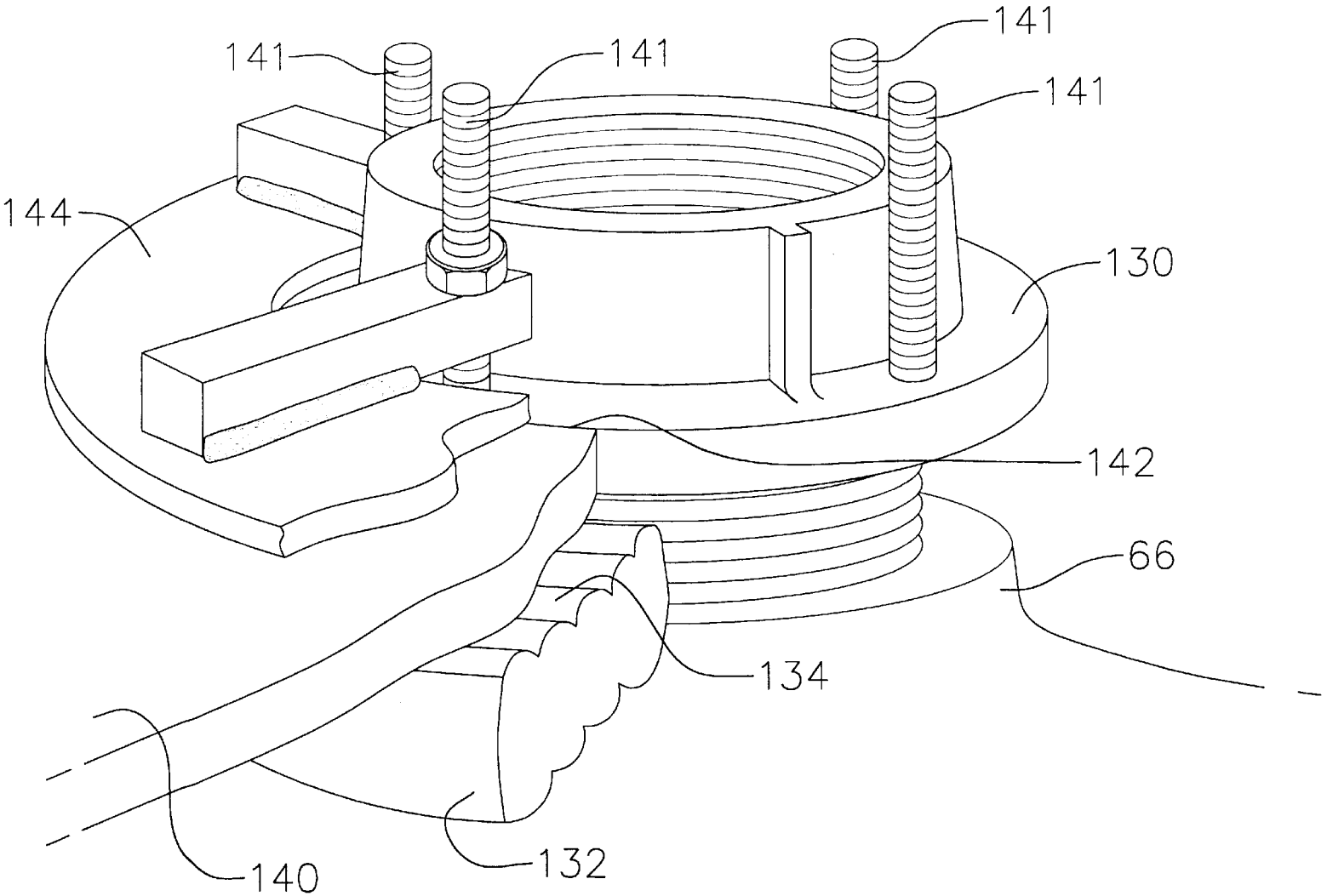
FIG. 17 is a alternate embodiment of the sump riser retrofit assembly.

Referring now to FIG. 17, another alternate embodiment of the sump riser retrofit assembly is illustrated which is adapted for use with the installation of hard bottom sump floors, for example with the containment sump of FIG. 1. The sump riser retrofit assembly includes a pipe extender 130, which is similar to pipe extender 110. In the embodiment illustrated in FIG. 17, a rubber seal 132 is placed around the tank bung 66. Preferably, Bostick or another suitable material is preferably provided between the rubber seal and the tank surface. Once the rubber seal is properly positioned around the tank bung 66, backfill material is placed around the rubber seal and leveled to about ⅛ inch below an upper surface 134 of the rubber seal. A plurality of threaded bolts or studs 141 are placed in the plurality of threaded bores provided in the pipe extender 130. The sump floor 140 is located and a hole 142 is cut in the sump floor to allow the sump floor to be placed over the pipe extender, and on the upper surface 134 of the rubber seal. Again, Bostick or another suitable material is preferably used between the sump floor and the upper surface of the rubber seal. A compression plate 144 is provided above the sump floor and has a plurality of bores corresponding to plurality of bores provided in the pipe extender. As a result, nuts or other collars may be used on the plurality of studs to tighten the compression plate toward the UST, which places the rubber seal under compression. In a presently preferred embodiment, the nuts are tightened such that the rubber seal is compressed sufficiently to allow the sump floor to rest substantially on the backfill material. Once the sump riser assembly is installed as described above, the riser pipe may be installed and the backfill completed.

Figure 18:
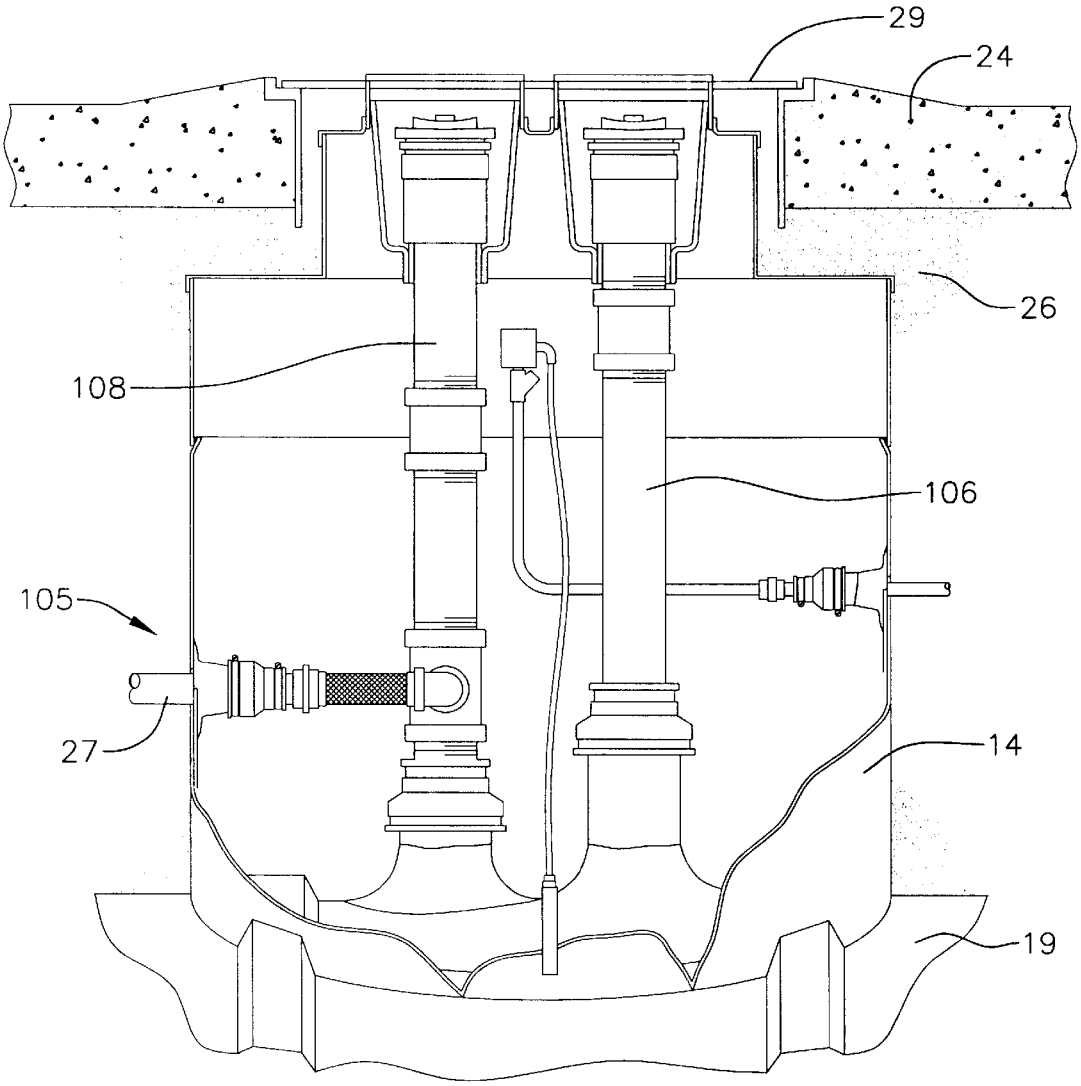
FIG. 18 is a cross-sectional view of sump to provide containment for a fill riser pipe and vapor recovery pipe.

As shown in FIG. 18, a similar sump 105 to that illustrated in FIGS. 1 and 2 could be constructed at the opposite end of the UST which would provide containment of the fill riser pipe 106, Stage I vapor recovery pipe 108, and any associated horizontal piping. The sump installation process would be essentially the same as for the turbine sump, with a separate riser sleeve, rubber seal and termination boot being installed around each riser pipe.

While various embodiments of this invention have been shown and described, it would be apparent to those skilled in the art that many modifications are possible without departing from the inventive concept herein. For example, the method of retrofitting a UST with a containment sump has been described in the approximate order in which the various steps are generally performed. However, those skilled in the art should realize that alternative sequences of steps may also be used to perform the present invention. Additionally, the present invention has been described in connection with exemplary materials and tools, those skilled in the art should also realize that other suitable materials and tools may alternatively be used with the present invention. It is, therefore, to be understood that within the scope of the appended claims, this invention may be practiced otherwise than as specifically described.

What is claimed is:

1. A method for retrofitting an underground storage tank with a containment sump having a sump wall, wherein the underground storage tank is buried beneath a layer of backfill material, the method comprising the steps of:

(a) providing a sump wall having a bottom edge;

(b) positioning the sump wall over the backfill material so that a portion of the backfill material is within the interior of the wall and a portion of the backfill material is outside the wall;

(c) removing the backfill material from the interior of the wall; and (d) lowering the wall as the wall's bottom edge is guided downward through the outside backfill material toward an upper surface of the underground storage tank.

2. The method according to claim 1 wherein the underground storage tank comprises a plurality of pipes that penetrate the sump wall and further comprising the steps of:

(e) cutting a substantially vertical slot in the wall when the bottom edge of the wall contacts one of the plurality of pipes to allow the pipe to penetrate the sump wall and the wall to pass over the pipe and continue moving downward through the outside backfill material;

(f) repeating step (e) until the bottom edge of the wall is substantially adjacent the upper surface of the underground storage tank;

(g) constructing a sump floor and affixing the sump floor to the bottom edge of the ring; and (h) sealing the vertical slot formed in step (e).

3. The method according to claim 2 further comprising the step of isolating each of the plurality of pipes that penetrate the sump wall from the sump wall.

4. The method according to claim 3 wherein the isolating step comprises providing a sleeve around each of the plurality of pipes that penetrates the sump wall and affixing the sleeve to the sump wall.

5. The method according to claim 4 further comprising the step of sealing the sleeve to a corresponding pipe by providing a termination boot over an end of the sleeve opposite the sump wall and clamping the termination boot to the pipe.

6. The method according to claim 2 wherein the underground storage tank further comprises a riser pipe and wherein the constructing step comprises constructing a sump floor with the riser pipe penetrating through the sump floor.

7. The method according to claim 6 further comprising the step of isolating the riser pipe from the sump floor.

8. The method according to claim 7 wherein the isolating step comprises providing a sleeve around the riser pipe and affixing the sleeve to the sump floor.

9. The method according to claim 8 wherein the isolating step further comprises providing a rubber seal adjacent a bottom edge of the sleeve to seal the sleeve to the upper surface of the underground storage tank.

10. The method according to claim 8 further comprising the step of sealing the sleeve to the riser pipe by providing a termination boot over an end of the riser pipe opposite the sump floor and clamping the termination boot to the riser pipe.

11. The method according to claim 1 wherein the step of providing a sump wall comprising providing a cylindrical ring having a bottom edge with a curvature substantially identical to a curvature of the upper surface of the underground storage tank.

12. A containment sump for an underground storage tank, wherein the storage tank is buried beneath a layer of backfill material and comprises a pipe that penetrates the sump, the containment sump comprising:

a sump wall having a bottom edge;

a vertical slot extending upwardly from the bottom edge of the wall to simultaneously allow the pipe to penetrate the sump wall and the wall to pass over the pipe as it is guided downward through the backfill material toward the underground storage tank;

a sump floor affixed to the bottom edge of the wall; and a stiffener section affixed to the sump wall to seal the vertical slot.

13. The containment sump according to claim 12 further comprising a pipe sleeve provided around the pipe and affixed to the sump wall to isolate the pipe from the sump wall.

14. The containment sump according to claim 13 further comprising a rubber termination boot provided around the pipe and the pipe sleeve to form a substantially liquid-tight seal between the pipe and the pipe sleeve.

15. The containment sump according to claim 12 wherein the underground storage tank comprises a riser pipe and wherein the containment sump further comprises a riser pipe sleeve provided around the riser pipe and affixed to the sump floor.

16. The containment sump according to claim 15 wherein the underground storage tank further comprises a tank bung into which the riser pipe extends, and wherein the containment sump further comprises a lower elastomeric seal provided between the tank bung and a bottom edge of the riser pipe sleeve.

17. The containment sump according to claim 16 further comprising a riser pipe assembly provided above the lower elastomeric seal for compressing the elastomeric seal toward the tank bung.

18. The containment sump according to claim 17 wherein the riser pipe assembly comprises an internally threaded riser pipe sleeve and wherein threading the riser pipe sleeve onto the riser pipe places the lower elastomeric seal under compression.

19. The containment sump according to claim 18 wherein the riser pipe assembly further comprises an externally threaded pipe extender provided between the tank bung and the riser pipe, and wherein the riser pipe sleeve threadably engages the pipe extender.

20. The containment sump according to claim 18 wherein an externally threaded collar is provided on the riser pipe, and wherein the riser pipe sleeve threadably engages the collar.

21. The containment sump according to claim 17 wherein the riser pipe assembly comprises a plurality of additional elastomeric seals provided above the lower elastomeric seal, a compression plate provided above the plurality of additional elastomeric seals, and a drive bolts for driving the compression plate downward to place the lower elastomeric seal under compression.

22. The containment sump according to claim 15 further comprising a rubber termination boot provided around the riser pipe and the riser pipe sleeve to form a substantially liquid-tight seal between the riser pipe and the sleeve.

23. The containment sump according to claim 12 wherein the bottom edge comprises a bottom edge having a curvature substantially identical to a curvature of an upper surface of the underground storage tank.

24. A riser pipe assembly adapted for use in an underground storage tank having a riser pipe and a containment sump around the riser pipe, the riser pipe assembly comprising:

a riser pipe sleeve provided around the riser pipe and adapted to be coupled to a floor of the containment sump;

a lower elastomeric seal provided between a bottom edge of the riser pipe sleeve and an upper surface of the underground storage tank; and a compression apparatus provided above the lower elastomeric seal for placing the lower elastomeric seal under compression.

25. The riser pipe assembly according to claim 24 wherein the compression apparatus comprises a compression plate provided above the lower elastomeric seal, and a drive bolt for driving the compression plate downward toward the upper surface of the underground storage tank.

26. The riser pipe assembly according to claim 25 further comprising a plurality of additional elastomeric seals provided between the compression plate and the lower elastomeric seal.

27. The riser pipe assembly according to claim 25 further comprising a clamp assembly coupled to the riser pipe above the compression plate, wherein the clamp assembly comprises a threaded bore for receiving the drive bolt, and wherein threading the drive bolt into the threaded bore places the lower elastomeric seal under compression.

28. The riser pipe assembly according to claim 24 wherein the compression apparatus comprises an internally threaded riser pipe sleeve and wherein threading the riser pipe sleeve onto the riser pipe places the lower elastomeric seal under compression.

29. The riser pipe assembly according to claim 28 wherein the compression apparatus further comprises an externally threaded pipe extender provided between the upper surface of the underground storage tank and the riser pipe for receiving the riser pipe, and wherein the threading the riser pipe sleeve onto the pipe extender places the lower elastomeric seal under compression.

30. The riser pipe assembly according to claim 28 wherein the compression apparatus further comprises an externally threaded collar provided on the riser pipe, and wherein the riser pipe sleeve threadably engages the collar.

* * * * *